US010316463B2

(12) United States Patent
Niccum et al.

(10) Patent No.: US 10,316,463 B2
(45) Date of Patent: Jun. 11, 2019

(54) NON-WOVEN COVERED ROLLER

(71) Applicants: Brent D Niccum, River Falls, WI (US); Christopher J Utech, Hudson, WI (US)

(72) Inventors: Brent D Niccum, River Falls, WI (US); Christopher J Utech, Hudson, WI (US)

(73) Assignee: NCCM Company, LLC, River Falls, WI (US)

( * ) Notice: Subject to any disclaimer, the term of this patent is extended or adjusted under 35 U.S.C. 154(b) by 1 day.

(21) Appl. No.: 15/386,921

(22) Filed: Dec. 21, 2016

(65) Prior Publication Data

US 2018/0171543 A1 Jun. 21, 2018

(51) Int. Cl.

| | |
|---|---|
| ***B21B 27/03*** | (2006.01) |
| ***D06M 101/34*** | (2006.01) |
| ***D06M 15/248*** | (2006.01) |
| ***D06M 15/564*** | (2006.01) |
| ***D06M 15/693*** | (2006.01) |

(52) U.S. Cl.

CPC ..... *D06M 15/248* (2013.01); *B21B 27/032* (2013.01); *D06M 15/564* (2013.01); *D06M 15/693* (2013.01); *D06M 2101/34* (2013.01); *D10B 2401/062* (2013.01)

(58) Field of Classification Search

CPC . D06M 15/327; D06M 2101/34; B21B 27/03; B21B 45/02; D10B 2401/062

USPC ..... 492/29, 48, 51, 52

See application file for complete search history.

(56) References Cited

U.S. PATENT DOCUMENTS

| | | | | |
|---|---|---|---|---|
| 2,807,124 | A | 9/1957 | Tachon | |
| 3,617,445 | A * | 11/1971 | Brafford | D21F 3/08 100/176 |
| 3,646,651 | A | 3/1972 | McGaughey | |
| 3,707,752 | A * | 1/1973 | Brafford | B29D 99/0035 492/52 |
| 3,710,469 | A * | 1/1973 | Kitazawa | B05C 1/0813 118/227 |

(Continued)

FOREIGN PATENT DOCUMENTS

JP 19870171972 A 1/1989

*Primary Examiner* — Jason L Vaughan

(74) *Attorney, Agent, or Firm* — Berggren Law Offices, LLC; William R Berggren

(57) ABSTRACT

A non-woven covered roller comprising a resin-saturated seamless non-woven tube on a shaft and a process for making the non-woven covered roller comprising non-woven fibers and a shaft surface completely covered with at least the same resin wherein the resin-saturated non-woven tube has a hardness of at least 40 wet Shore A. It also has an outer surface configured to both trap metal debris from a metal web during primary metal fabrication operations and temporarily compress to allow larger metal debris associated with the metal web to pass by without permanently damaging the outer surface of the non-woven covered roller. Furthermore, it has an inner surface sufficiently bonded with the same resin to the outer surface of the shaft to permit satisfactory life of the resin-saturated non-woven covered roller during primary metal fabrication conditions similar to that of conventional shafts that are covered with rubber, urethane, or vinyl, and have not been exposed to the metal debris.

18 Claims, 11 Drawing Sheets

(56) References Cited

U.S. PATENT DOCUMENTS 3,800,381 A * 4/1974 Brafford ..... B29C 63/0021 492/56
3,853,677 A * 12/1974 Kai ..... B29D 99/0035 492/41
3,909,893 A * 10/1975 Wilde ..... D04H 3/07 28/110
3,926,701 A 12/1975 Nishiwaki
4,032,688 A * 6/1977 Pall ..... B01D 25/001 210/494.1
4,124,731 A * 11/1978 Dilo ..... D04H 18/00 428/34.1
4,138,772 A * 2/1979 Dilo ..... D04H 18/02 28/110
4,368,568 A * 1/1983 Watanabe ..... B29D 99/0035 492/52
4,390,574 A * 6/1983 Wood ..... D04H 1/4218 428/212
4,400,418 A 8/1983 Takeda et al.
4,492,012 A 1/1985 Pala et al.
4,603,075 A 7/1986 Dergarabedian et al.
4,669,163 A * 6/1987 Lux ..... B29D 99/0035 29/895.213
4,708,756 A * 11/1987 Busen ..... B29C 53/785 156/143
4,955,116 A * 9/1990 Hayamizu ..... D04H 1/46 28/110
5,038,448 A * 8/1991 Gusmer ..... B29D 99/0035 492/41
5,247,740 A * 9/1993 Curtis ..... B21B 45/0275 29/895.21
5,366,576 A * 11/1994 Clack ..... B01D 39/163 156/169
5,468,531 A * 11/1995 Kikukawa ..... G03G 15/2057 428/304.4
5,474,525 A * 12/1995 Blott ..... A61F 13/041 602/63
5,674,020 A * 10/1997 Kimura ..... B05C 1/0808 101/376
5,765,256 A * 6/1998 Allan ..... A46B 13/001 15/230
5,800,745 A * 9/1998 Miyahara ..... B05C 1/0808 264/13
6,042,918 A 3/2000 Appelt et al.
6,110,281 A * 8/2000 Nelson ..... B05C 11/025 118/203
6,170,531 B1 1/2001 Jung et al.
6,300,261 B1 10/2001 Young et al.
6,336,972 B1 * 1/2002 Kimura ..... G03G 15/2025 118/264
6,519,440 B2 * 2/2003 Kimura ..... G03G 15/2025 118/258
6,579,813 B1 * 6/2003 Kimura ..... G03G 15/2025 118/60
6,666,939 B2 * 12/2003 Kimura ..... G03G 15/2025 118/268
6,784,125 B1 * 8/2004 Yamakawa ..... D04H 3/14 428/113
6,869,385 B2 * 3/2005 Kimura ..... G03G 15/2025 492/51
8,858,750 B2 10/2014 Sinykin
9,260,800 B1 * 2/2016 Tao ..... D01D 5/16
2015/0148206 A1 5/2015 Bischof et al.

* cited by examiner

PROPERTIES OR EXAMPLES

| PROPERTY | EXAMPLE 1 | EXAMPLE 2 | EXAMPLE 3 | EXAMPLE 4 | EXAMPLE 5 | EXAMPLE 6 |
|---|---|---|---|---|---|---|
| RESIN:WATER, WT RATIO | 100:0 | 68.15:31.85 | 61.15:38.85 | 50:50 | 40:60 | 25:75 |
| RESIN/NONWOVEN, WT RATIO | 38.0:62.0 | 19.7:80.3 | 19.6:80.4 | 16.9:83.1 | 16.9:83.1 | 8.3:91.7 |
| RESIN WEIGHT, G | 744 | 300 | 290 | 250 | 251 | 111 |
| RESIN CTD NONWOVEN TUBE WT, G | 1957 | 1525 | 1479 | 1481 | 1483 | 1331 |
| INNER TUBE DIAMETER, IN (CM) | 7.25 (18.4) | 7.25 (18.4) | 7.25 (18.4) | 7.25 (18.4) | 8.25 (21.0) | 7.25 (18.4) |
| UNFINISHED OD, IN(CM). | 8.9 (22.6) | 8.9 (22.6) | 8.9 (22.6) | 8.9 (22.6) | 9.9 (25.1) | 8.9 (22.6) |
| FINISHED OD, IN. | 8.80 (22.4) | 8.55 (21.7) | 8.51 (21.6) | 8.55 (21.7) | 9.55 (24.3) | 8.47 (21.5) |
| TUBE LENGTH, IN (CM) | 9.5 (24.1) | 9.5 (24.1) | 9.5 (24.1) | 9.5 (24.1) | 10.5 (26.7) | 9.5 (24.1) |
| TUBE FIBER DENSITY, G/CUBIC IN (G/CC) | 6.10 (0.37) | 6.16 (0,38) | 5.98 (0.36) | 6.19 (0.38) | 4.99 (0.30) | 6.14 (0.37) |
| VOID VOLUME, % | 45.8 | 58.2 | 59.5 | 59.5 | 67.4 | 63.8 |
| SHORE A WET | 96 | 88 | 85 | 77 | 78 | 60 |
| SHORE A DRY | 71 | 65 | 61 | 60 | 61 | 62 |

Fig. 8

NON-WOVEN COVERED ROLLER

FIELD OF THE INVENTION

This invention relates to covered rollers for use in primary metal working and particularly to non-woven covered rollers.

BACKGROUND OF THE INVENTION

Covered rollers have been used as mill rolls for decades in primary metal fabrication operations. They are broken down in to two groups. The first group of covered rollers as mill rolls is shafts covered with a rubber, urethane, or vinyl covering. These rollers are particularly useful where expense is an issue and performance in fluid environments, particularly acidic or caustic, is not required. Included in this group, for example, are covered rollers used as brindle rolls, table rolls, deflecting rolls, and steering rolls.

The second group of covered rollers as mill rolls is covered with non-woven material. These covered rollers are much more expensive than rubber, urethane, or vinyl covered rollers but, typically, have a significantly longer life, higher coefficient of friction, and better fluid wringing properties than their rubber, urethane, or vinyl covered shaft counterparts. These covered rollers are particularly useful in situations where they are exposed to oils or acidic or caustic conditions. Included in this group, for example, are covered rollers used as snubber rolls, pinch rolls, de-oiler rolls, cleaning rolls, wringer rolls—both oil applications and chemical solution application, and oiler rolls.

The current use of non-woven covered rollers is dictated by cost and performance. Typically, the non-woven covered rollers are made by first coating a non-woven web with a resin and curing the resin, stamping out hollow disks, stacking and compressing the disks into a hollow cylinder, and retaining the cylinder to a metal shaft with retention plates and keys. These large number of steps result in covered rollers that are much more expensive than rubber, urethane, or vinyl covered rollers. However, because non-woven webs on a non-woven covered rollers have a void volume, their surfaces are able to remove small metal debris from metal webs during metal fabrication processes and temporarily compress when exposed to larger debris without tearing or cutting as occurs with rubber, urethane, or vinyl covered rollers. Non-woven covered rollers are typically used in situations where the larger number of steps resulting in significantly higher costs over those of the first group are worth one or more of longer life, higher surface friction, harder surfaces, and the presence of void volume that provide self-cleaning characteristics, greater damage resistance, and excess fluid removal capability.

SUMMARY OF THE INVENTION

There is an ongoing need for covered rollers with the performance suitable for use in primary metal fabrication currently associated with rubber, urethane, or vinyl coated shafts. There is also a need for non-woven covered rollers that are made with fewer steps than current non-woven covered rollers but have superior properties over rubber, urethane, and vinyl covered rollers as used in the metal fabrication industry.

In one aspect, non-woven covered roller is provided that includes a shaft with a uniform smooth outer surface and a resin-saturated non-woven seamless tube adhered to the shaft. The resin-saturated non-woven seamless tube with an outer surface and an inner surface includes a non-woven seamless tube comprising a needle-tacked web of fibers formed into a seamless tube The non-woven seamless tube also includes a continuous resin layer that saturates both the non-woven seamless web and coats the outer surface of the shaft to bond it to the non-woven web with sufficient force to permit under primary metal fabrication conditions a lifespan when exposed to metal debris from a metal web during fabrication operations of the non-woven covered roller that is at least similar to that of rubber, urethane, or vinyl covered rollers that have not been exposed to the metal debris. The provided resin-saturated non-woven covered roller can be made with fewer steps than current non-woven covered rollers and can have superior properties over rubber, urethane, and vinyl covered shafts as used in the metal fabrication industry.

In another aspect, a method of making a non-woven covered roller is provided that includes providing an unconverted resin that when converted forms a resin stable at the conditions of metal working, a seamless non-woven tube comprising physically adhered non-woven fibers, and a shaft with an outer surface. The method further includes applying the seamless non-woven tube to the shaft and then coating the non-woven tube covered shaft with the unconverted resin so that the non-woven covered shaft becomes saturated with a continuous layer of resin that contacts both the fibers and the outer surface of the shaft. The method further includes rotating the unconverted resin-saturated non-woven seamless tube covered shaft under resin converting conditions to form a resin-saturated non-woven seamless tube adhered to the shaft described above.

As used herein:

"Metal debris" refers to debris from a metal web being fabricated into a more useful form wherein the debris can range in size from smaller particles that are able to be imbed into the surface of a roller covered with a smooth material such as rubber, urethane or vinyl to scratch or mar the surface of a metal web during the process or larger pieces or metal defects such as burrs on metal web edges sufficiently sized to tear or cut a roller covered that may tear or cut the smooth surface to render the covered roller unusable in its application.

"Surface opening" refers to the opening of a void volume as it appears on the surface of a non-woven covered roller;

"Void volumes" refers to irregularly shaped voids having a volume of at least 4 and not more than 85 percent of the resin coated non-woven web and an average surface opening and depth sufficient to capture small particles with a long dimension on the order of less than 0.5 inch (in) (13 millimeter (mm)) and a short dimension on the order of less than 0.13 in (3.2 mm)

BRIEF DESCRIPTION OF THE DRAWINGS

One or more features or preferred forms of the invention are described in the accompanying drawings. The drawings are described briefly below.

FIG. 8 is a table of characteristics of Examples.

Figure 1:
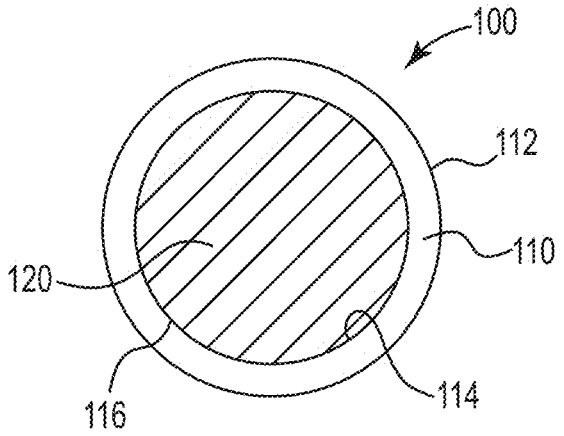
FIG. 1 is a cross-section of a shaft with a uniform smooth outer surface used in an embodiment of a provided non-woven covered roller.

While the invention is amenable to various modifications and alternative forms, specifics thereof have been shown by way of example in the drawings and will be described in detail below. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION

A non-woven covered roller is provided that includes a shaft that has a uniform smooth outer surface and a resin-saturated seamless non-woven tube adhered to the shaft. The provided non-woven covered roller has a different structure, can be made with fewer steps than a current non-woven covered roller, and is significantly less expensive as a result. The provided non-woven covered roller has many of the superior properties of non-woven covered rollers over those of rubber, urethane, or vinyl covered shafts used in the primary metal fabrication industry. Accordingly, embodiments of the invention may be used to replace rollers covered with rubber, urethane, or vinyl in many areas of the metal fabrication process. These include, for example covered rollers used as brindle rolls, table rolls, deflecting rolls, and steering rolls. In addition, some embodiments of the invention may be used in some applications presently addressed with higher priced current non-woven covered shafts. These include, for example, covered rollers used as snubber rolls, pinch rolls, de-oiler rolls, cleaning rolls, wringer rolls—both oil applications and chemical solution application, and oiler rolls.

Non-woven materials are commonly used in primary metal fabrication facilities as a high performance replacement for rubber, urethane, or vinyl rollers. These conventional non-woven rolls are typically 5 to 10 times higher in price and their typical production method has a high level of material waste due to a need to cut discs out of non-woven fabric saturated with cured resin. In addition to the high material costs, conventional non-woven covered shafts generally require specially designed shafts to be produced that contain keys that hold the stack of discs between mounting plates to the shaft under metal fabricating conditions. These designed non-woven covered shafts then are used in place of the shafts covered with a rubber, urethane, or vinyl.

The provided non-woven covered rollers can be made with a process that has minimal waste. The provided method allows customers to use an existing shaft to reduce the cost of making some embodiments of the provided non-woven covered roller to be competitive with that of current methods of making rubber, urethane, or vinyl covered shafts. At the same time, the non-woven covered rollers of the invention deliver the vastly better performance to the primary metal fabrication process than available with rubber, urethane, or vinyl covered rollers.

Apparatus

In one aspect, provided are non-woven rollers that include a shaft and a resin-saturated seamless non-woven covered roller. In some embodiments, the resin is a curable resin and is cured. In some embodiments, the resin is a dryable resin and is dried. In some embodiments, the resin is a curable and dryable resin and is both cured and dried. The shaft can have a uniform smooth outer surface. The provided shaft can be useful in metal fabrication processes. The shaft can be similar to shafts currently used with rubber, urethane, or vinyl coatings and are durable under metal fabrication conditions an may be of, for example, metal, ceramic, plastic, or a composite. In some embodiments the outer surface of the shafts are smooth. In other embodiments the outer surface may be slightly roughened. In some embodiments, the outer surfaces are prepared for use by such methods as, for example, cleaning, buffing, or smoothing.

The resin-saturated seamless non-woven tube adhered to the shaft can have a hardness of at least 35 wet Shore A, and a void volume of at least 4 percent. It can have an outer surface that includes a void volume capable of trapping metal debris from a metal web during primary metal fabrication operations and capable of temporarily compressing to allow defects associated with the metal web to pass by without permanently damaging the outer surface of the non-woven tube. These properties are typical of those found with current non-woven covered rollers formed by a stack of discs held between two plates.

The provided non-woven tube has an inner surface sufficiently bonded to the outer surface of the shaft so as to permit satisfactory life of the non-woven covered roller during primary metal fabrication conditions similar to that of conventional shafts that are covered with rubber, urethane, or vinyl, particularly when they have not been exposed to debris from the metal web being fabricated. While current non-woven covered rollers are sufficiently bonded to each other, that bond is achieved through different means that result in inherently more waste and higher specially-tailored shaft design costs than are associated with the provided rollers.

The resin-saturated seamless non-woven tube has an outer surface and an inner surface can include both a non-woven seamless web formed into a tube and a resin. The non-woven seamless tube is made by using the process of needle-tacking that is well known in the industry to adhere fibers in a non-woven felt web to form a seamless tube with a wet Shore A hardness of at least 35.

Shore A hardness can be influenced by the resin type, resin content, and non-woven type, and compaction through needle-tacking. In the primary metal fabrication process, satisfactory Shore A hardness depends on the specifics of the application. Where removal of acidic, caustic, or oily fluids is desired, harder covered shaft surfaces are generally desired. Where less demanding applications are sought such as for table rolls, less hard surfaces are needed. Dry Shore A hardness properties are easier for a customer to measure while Wet Shore A hardness, sometimes lower for some resins and fiber combinations, is the hardness of the roll in use. In some embodiments, satisfactory Dry Shore A may range from over 35, over 40 or over 50, to less than 100, less than 90 or less than 80. In some embodiments, satisfactory Wet Shore A may range from over 35, over 40, over 50 or over 60, to less than 100, less than 90 or less than 80.

Those skilled in the art of non-wovens will recognize the wide selection of materials which will allow non-woven covered shafts to be optimized for different applications. The characteristics that need to be considered for use in primary metal fabrication include, for example, chemical resistance, elasticity, and strength, adhesion both to non-woven fibers and to outer shaft surfaces, temperature capability, and abrasion resistance. Polyamides such as, for example, nylon 6,6, are excellent choices for neutral PH and oil environments. While polyethylene terephthalate (PET) is a low cost alternative, the poor adhesion characteristics cause a weaker construction that is unsuitable in some application. For extreme acids and caustic environments a polyolefin such as, for example, polypropylene, is a popular choice for its chemical resistance and low cost. In high temperature environments there are a number of technical fibers such as para-amid, sold as Kevlar, and ceramic fibers that can be used. It is also common to blend fiber types to achieve a desired performance.

The fiber density of the non-woven tube can affect the ability of the resin-saturated seamless non-woven tube having satisfactory self-healing abilities in general and, optionally, liquid removal properties in specialized applications such as wringing in the primary metal fabrication process. Enough resin can be added to achieve satisfactory cohesion within the resin-saturated seamless non-woven tube and satisfactory adhesion of the tube to the outer surface of the shaft. This amount can vary with the application in the primary metal fabrication process and the specific conditions used for a specific metal product. Resin addition can lower the void volume of fibers that have already been densified in processes such as needle-tacking in tube making processes. A non-woven tube with a fiber density of 3 grams per cubic inch (0.11 ounces per cubic inch or 0.19 grams per cubic centimeter) can have a void volume of 84%. A non-woven tube that has a fiber density of 8 grams per cubic inch (0.28 ounces per cubic inch or 0.50 grams per cubic centimeter) can have a void volume of 57%. In some embodiments of the provided non-woven covered rollers, the resin-saturated non-woven seamless tube can have a density of at least 5 grams per cubic inch (0.18 ounces per cubic inch or 0.31 grams per cubic centimeter) and up to over 18 grams per cubic inch (0.63 ounces per cubic inch or 1.10 grams per cubic centimeter).

Similarly, there is a wide selection of resins which will allow non-woven fibers to adhere where they connect, to encompass fibers for enhanced properties and to adhere non-woven tubes to outer surfaces of shafts under varying conditions in the primary metal fabrication process. Needs of dry table rolls may be addressed with embodiments that have resins that merely dry from a solution or mixture. Needs of rolls that have contact with wet conditions generally are addressed with embodiments where the resin cures or crosslinks. Resin or resins may be chosen to optimize performance characteristics for different applications. Common resins suitable for wet conditions include, for example, nitrile rubbers, urethanes, epoxies, and acrylates, often as emulsions with catalysts and surfactants. However many other choices are available based on the required properties that are minimally affected by the environment it is in. The resin should have satisfactory strength, adhesion to the fiber, adhesion to the outer surface of the shaft, elastic properties, and chemical resistance. Some achieve this by simply drying and others by curing or crosslinking. Some achieve crosslinking through catalysts with radiation such as, for example, heat or ultraviolet. Others achieve crosslinking through two part reactions such as, for example, epoxies. Nitrile rubbers have excellent chemical resistance for acids and caustics. Urethanes have excellent strength and elasticity. Acrylates offer a nice blend of all properties in PH neutral environments.

"Saturated" refers to fibers that are completely coated, not only at the point of contact between two fibers, but also along the lengths between points of contact. This results in a stability of structure of the resin-saturated seamless non-woven tubes on a shaft while the embodiment is subject to periods of pressure under increasing temperatures for a length of time that exceeds that of rubber, urethane, or vinyl covered shafts. This can be at least 344.7 kPa (50 PSI (pounds/square inch)) or at least 517.1 kPa (75 PSI) of nip pressure at up to 149° C. (300° F.).

In addition, the resin that saturated the fibers of the non-woven also coats the outside surface of the shaft to form a satisfactory bond. In the primary metal fabrication process, a satisfactory bond is one that can withstand process nip force at a possible process temperature for a time that is at least as long as that of rubber, urethane, or vinyl covered shafts. These can be up to at least 50 PSI (344.7 kPa) of nip force at up to at least 300° F. (149° C.).

As discussed above, the applications for the provided non-woven covered roll in the primary metal fabrication process are diverse. Whether the resin needs only to dry as with, for example, table roll applications, or also cure, also known as crosslink, some resin properties are similar and others are different. Those skilled in the art would be able to customize the type of resin needed to optimize specific embodiments for different situations. Applications limited to standard table rolls may use resins that either dry or cure and are not limited to a single type of resin. In all cases, the resin needs be configured to be able to migrate through the non-woven web to coat the outer surface of the shaft before it is converted to a dried, cured, or dried and cured resin.

In some embodiments, an additional adhesive may be used to augment the adhesion properties of the resin used to adhere the non-woven tube to the outer surface of the shaft. The adhesive may be one of many known curable adhesives that would be suitable in conditions of primary metal fabrication and may be curable, dryable, or both curable and dryable. The adhesives may also be miscible or immiscible with the resins and are used to enhance adhesion of the resin-saturated seamless non-woven tube to the outside of the shaft under fabrication conditions. Such augmentation could render the non-woven covered rollers of the invention suitable for applications that may require adhesion under extreme conditions not typically seen in more routine primary metal fabrication processes.

The provided non-woven covered roller can have chemical resistance to oils, lubricants, hydrocarbons, and water. In some embodiments, the chemical resistance of the provided non-woven covered rollers can exceed that of the uncoated non-woven web.

In some embodiments of the invention, the void volume of the resin-saturated non-woven seamless tube can be more than 4 percent and less than 63 percent. Void volume should be at least 4 percent of the resin-saturated seamless non-woven tube of the invention. Such void volume creates desired self-healing and metal debris sweeping of the metal sheet being processed. Void volume depends on such factors as the stiffness, e elasticity, and diameter of the resin-saturated fibers and the compaction of the resin-saturated fibrous web. Some embodiments may have a void volume that is at least 10 percent, at least 20 percent, or at least 30 percent. Void volume should not exceed that of a non-woven that has been compacted with techniques well known to the art such as needle-tacking. Typically for the primary metal fabrication process, this is not more than 75. Some embodiments have a void volume of less than 75 percent, some less than 60 percent and some less than 50 percent.

In some embodiments, resin-saturated seamless non-woven tube can be in a weight ratio of resin to non-woven fiber of at least 10:90. This results in a stable construction under the primary metal fabrication process conditions for the time desired that is at least as long as that of rubber, urethane, or vinyl covered rollers. In some embodiments, the ratio of resin to non-woven fiber is at least 15:85, at least 20:80, or at least 25:75. When the resin in the ratio is increased, care should be taken to keep the ratio low enough to result in a void volume that is at least 4 percent. Any lower ratio can result in unsatisfactory removal of metal debris and self-recovery when metal debris pass that would tear surfaces of rubber, urethane, or vinyl covered shafts. Some embodiments have resin to non-woven fiber weight ratios of less than 85:15, some less than 80:20, some less than 75:25, and some less than 70:30.

In some embodiments, the provided non-woven covered roller can have a satisfactory operational lifespan during primary metal fabrication conditions that is at least 2 times as long as that of a conventional shaft covered with rubber, urethane, or vinyl during similar conditions. In some embodiments, the lifespan can be at least 3 times, at least 4 times, at least 5 times, at least 6 times, or at least 8 times.

In some embodiments of the non-woven covered rollers additional adhesives may be used to augment the adhesion of the resin-saturated seamless non-woven tube to the outer surface of the shaft for primary metal fabrication processes involving more extreme conditions. The additional adhesive may be in the form of at least one discontinuous layer of adhesive between the resin and the outer surface of the shaft. This additional adhesive may be distinct or may be intermixed with the resin. It also may be in the form of a continuous layer intermixed with the resin. In some embodiments, this additional adhesive layer can have a thickness of less than 5.1 millimeters (200 mils).

In some embodiments, the provided roller can be substantially unaffected by exposure to materials such as water and oil with a pH of between over 2 and under 10 and volatile organic compounds typically used in metal working operations. This is particularly true when the resin is a cured resin.

In some embodiments, the provided non-woven covered roller can be substantially unaffected by exposure to materials from a group consisting of caustic and acidic environments with a pH of between 1 and 14. This is particularly true when the resin is selected from a cured resin.

In some embodiments, the non-woven covered roller can be configured to operate at temperatures of up to over 149° C. (300° F.) and pressures of up to over 75 PSI of roll face (517.1 kPa).

Figure 2:
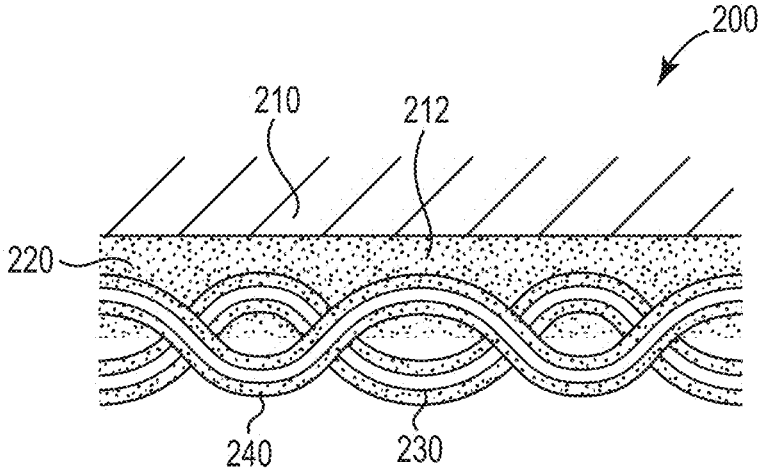
FIG. 2 is a magnified view of a section of the interface between the resin-saturated non-woven and the shaft shown in FIG. 1.

FIGS. 1 and 2 illustrate the apparatus of the invention. FIG. 1 is a cross-section of a shaft with a uniform smooth outer surface used in an embodiment of a provided non-woven covered roller. Non-woven covered roller 100 is shown with a resin-saturated seamless tube 110 having an outer surface 112. It also has an inner surface 114 that is affixed to the outer surface 116 of shaft 120.

FIG. 2 is a magnified view of a section of the interface between the non-woven seamless tube and the shaft shown in FIG. 1. Section 200 is shown. Outer surface of shaft 210 is covered with resin layer 212. Embedded in resin layer 212 are non-woven covered fibers 230 coated with resin 240. In the illustrated embodiment, the resin used to coat both the shaft and fibers is the same.

Figure 3:
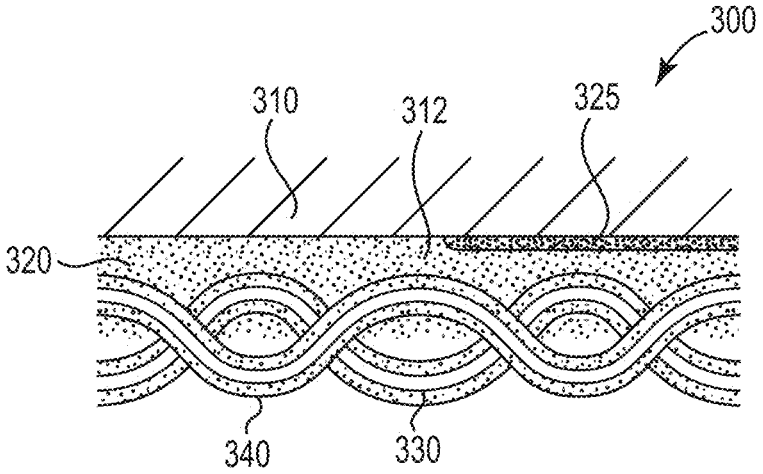
FIG. 3 is a magnified view of a section of the interface between the resin-saturated non-woven and the shaft similar to that shown in FIG. 1 but with an additional partially coated region of adhesive.

FIG. 3 is a magnified view of a section of the interface between the non-woven seamless tube and the shaft similar to that shown in FIG. 1 but with an additional partially-coated region of adhesive. Section 300 is shown. Outer surface of shaft 310 is covered with resin layer 312 and discontinuous adhesive layer 325. Embedded in resin layer 312 are non-woven covered fibers 330 covered with resin 340. The resin used to coat the shaft and fibers is the same resin.

Method

The provided method of making the non-woven covered roller can allow non-woven covered rollers to be competitive in cost with rubber, urethane, or vinyl covered rollers in the primary metal fabrication process while still retaining many of the superior properties of conventional non-woven covered rollers.

The provided method includes providing an unconverted resin that when converted is stable at the conditions of metal working, a seamless non-woven tube that includes physically adhered non-woven fibers, and a shaft with an outer surface. The resin should be chosen as described above for the application desired. The viscosity, Brookfield at 25° C. (77° F.), should be less than 300 centipoise (cP) for the unconverted resin to allow the unconverted resin to migrate through the non-woven to the outside of the shaft during drying and or curing. In one embodiment, the viscosity is less than 100 cP, in one it is less than 50 cP, in one it is less than 25 cP, and in one it is less than 20 cP. In one embodiment, the resin is can be an acrylic latex emulsion.

The provided seamless non-woven tubes may be sized to snugly fit onto an existing shaft once the shaft surface is prepared. Non-woven tubes, also called felt tubes, can be formed starting with staple fiber that is carded into loose formed web. This web can be fed into needle punching or needle tacking machine such as a cantilevered felting needle loom, perpendicular to the resulting tube surface. The felting needles may be barbed and are forced through the non-woven web to mechanically interlock the fibers and densify the tube simultaneously. A fixture attached to the end of the formed felt tube can rotate and slowly extract the felt tube as it is formed in the direction of the formed felt tube. Once enough length is formed, it can be cut off of the end and to form a felt tube. One such fixture or machine is commercially available from Dilo with the brand name RONTEX. Because any waste is not yet coated with resin, the non-woven waste may be reused completely by adding it to the non-woven web before it is formed in to a tube. In some embodiments, the seamless non-woven tube can be further needle-tacked to increase the density of the fiber packing and result in a hardness of at least 35 dry Shore A.

The method described herein also includes providing a shaft with an outer surface. This shaft may be the same shaft that is used for rubber, urethane, or vinyl covered shafts in the primary metal fabrication process. In these situations, the shafts are prepare by removing the coverings and cleaning and smoothed the outer surfaces as needed. Unlike conventional non-woven covered roll processes, the invention does not require special shafts with keys for holding in place stacks of non-woven disks bound on both ends with end plates. The seamless non-woven tube with an outer surface can be applied to the shaft. In some embodiments, this may be accomplished by simply sliding the previously sized tube onto the shaft.

The provided method also includes coating the non-woven tube with an unconverted resin until the non-woven tube is saturated with a continuous layer that contacts both the outer surfaces of the fibers at least at their points of contact and the outer surface of the shaft is covered to form a resin-saturated non-woven seamless tube covered shaft. Various coating methods may be employed such as, for example, spray coating, dip coating, roll coating, or a combination of these methods to achieve a saturated seamless non-woven tube. Saturation describes a state where at least all points of fiber contact with other fibers or with the outer surfaced of the shaft are covered with resin. In some embodiments, saturation also describes a state where all fibers are coated with resin and the outer surface of the shaft is coated with resin. In one embodiment, the shaft is placed on a jig that continuously rotates the shaft off of the shaft journals. While the shaft is rotating, a low viscosity latex resin emulsion is poured over the non-woven material until it is completely saturated.

The provided method also includes continuously rotating the resin-saturated non-woven seamless tube covered shaft under resin converting conditions to form a non-woven covered roller having a hardness of at least 35 wet Shore A and a void volume of at least 4 percent. The provided roller has an outer surface that includes a void volume capable of trapping metal debris from a metal web during primary metal fabrication operations and capable of temporarily compressing to allow debris associated with the metal web to pass by without permanently damaging the outer surface of the non-woven tube. The provided roller also has a non-woven seamless web that includes an inner surface sufficiently bonded to the outer surface of the shaft to permit satisfactory life of the non-woven covered roller during primary metal fabrication conditions similar to that of conventional shafts that are covered with rubber, urethane, or vinyl and have not been exposed to the debris. The provided roller includes both a non-woven seamless web having an outer surface and an inner surface, and including needle-tacked fibers formed into a non-woven seamless tube, and a cured continuous resin layer continuously coating both all of the needle-tacked fibers and the outer surface of the shaft to form the cured resin-saturated non-woven seamless tube adhered to the outer surface of the shaft.

In one embodiment, the unconverted resin can be dried and solidified onto the non-woven fibers and outer surface of the shaft while the shaft is rotating to result in a satisfactory distribution of resin on the fibers and shaft surface. Rotation may or may not be continuous. Drying can shrink and bond the resin-saturated seamless non-woven tube to the outer surfaced of the shaft forming a soft cover material. This is suitable for less stressful roll applications such as a table roll.

In one embodiment, the unconverted resin can be a curable resin emulsion. A jig, upon which the resin-coated non-woven seamless tube covered shaft is rotated, can be moved into an oven to dry and to cure the curable resin while the jig is continuously rotating. Rotating may or may not be continuous. The combination of drying and curing can shrink and bond the resin-saturated seamless non-woven tube to the outer surface of the shaft to a greater degree than above. Such embodiments are suitable for rolls used under more severe conditions such as pinch, nip, and wringer applications in the primary metal fabrication process. These embodiments can have very good properties such as, for example, operating lives of up to 100 times longer than rubber, urethane, or vinyl covered rollers, superior damage resistance, non-marking qualities, and a coefficients of friction that are up to 30 times higher than the rubber, urethane, or vinyl covered rollers. In some embodiments, the resin-saturated seamless non-woven covered roller can have a weight ratio of cured resin to non-woven fibers of at least 10:90.

In some embodiments, the provided non-woven covered roller can be suitable for use in primary metal fabrication where shafts covered with rubber, urethane, or vinyl are currently used.

In some embodiments, the provided non-woven covered roller can be suitable for use in primary metal fabrication as rolls such as brindle rolls, deflector rolls, table rolls, ironing rolls, and steering rolls.

In some embodiments, the provided non-woven covered rollers can be suitable for use in primary metal fabrication as nip rolls and wringer rolls.

In some embodiments, the unconverted resin can be a curable resin and solidifying the resin can include removing the solvent while continuously rotating the resin coated non-woven seamless tube. These conditions typically involve heat for a time of between 10 min and 60 min at a temperature of between 100 and 300 degrees F. (38° C. and 149° C.). Other means of curing, such as with ultraviolet radiation may be suitable where the curable monomers and/or oligomers are used as photocurable resins.

In some embodiments, the method of making further can include "dressing" the outer surface of the resin-saturated seamless non-woven covered roller. Dressing is well known in the art of metal fabrication is an operation that removes irregularities from the roller surface in order to expose the metal web being fabricated with a smooth surface that will not mar the surface of the metal web. Dressing prepares the roller for use in primary metal fabrication as a shaft with a resin-saturated non-woven seamless tube having a hardness of at least 40 wet Shore A.

In some embodiments, the method of making can further include providing a convertible adhesive and coating the surface of the shaft with a thin layer of convertible adhesive before applying the seamless non-woven tube to the shaft. The method can also include converting the convertible adhesive along with converting the convertible resin to form a thin layer of adhesive that is at least partially intermixed with the resin to increase the adhesion of the resin-saturated non-woven tube to the shaft upon converting to withstand more extreme conditions during primary metal fabrication. The convertible adhesive may be converted in to an adhesive able to withstand fabrication conditions by any of known methods such as drying, curing, and both drying and curing. Curing methods include heating, or exposing to other forms of radiation. In some embodiments that use the convertible adhesive, the convertible thin layer of adhesive can be continuous in nature over the outer surface of the shaft and can have a thickness of less than about 5.1 mm (200 mils).

In some embodiments, the provided method of making further includes injecting a convertible adhesive to the interface between the inner surface of the non-woven tube and the outer surface of the shaft after applying the seamless non-woven tube to the shaft. The convertible adhesive is injected so as to form at least one isolated discontinuous region of convertible adhesive at the interface that only partially covers the shaft surface.

The method can further include converting the convertible adhesive along with converting the convertible resin to form at least isolated regions of adhesive that are at least partially intermixed with the resin to increase the adhesion of the resin-saturated seamless non-woven tube to the shaft upon conversion to withstand more extreme conditions during primary metal fabrication. In some embodiments, the discontinuous convertible layer of adhesive is continuous and is intermixed with the converting resin, and has a thickness of less than about 5.1 mm (200 mils).

Figure 4:
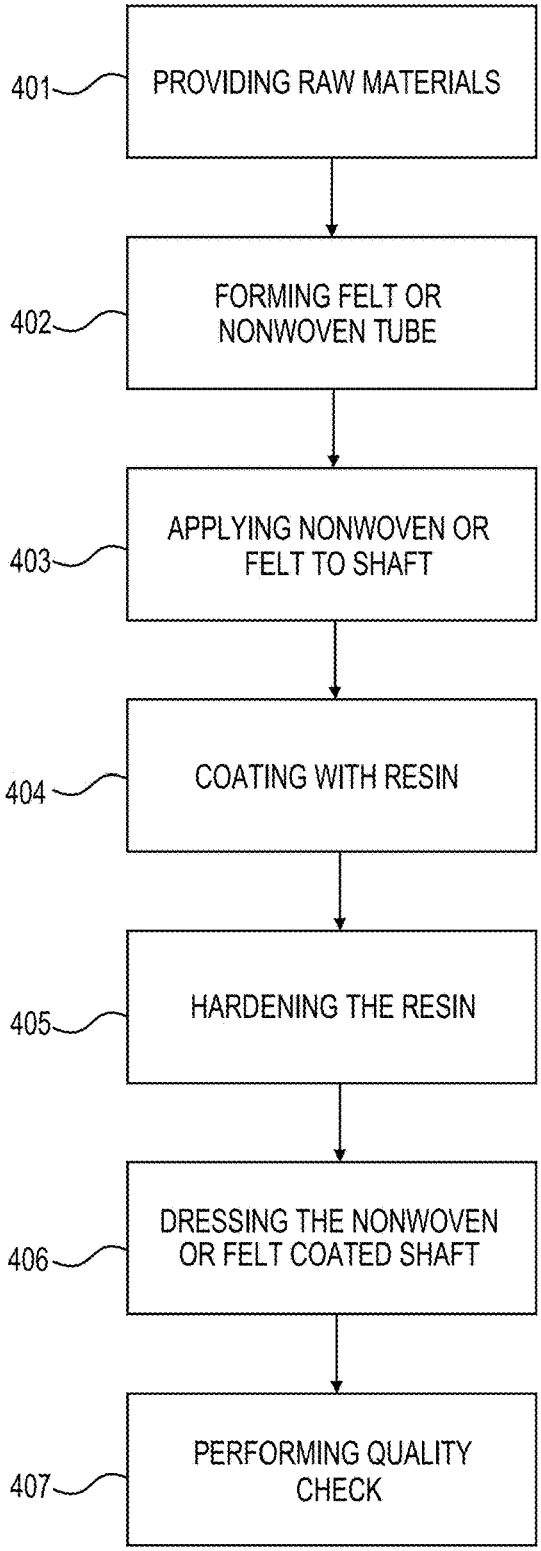
FIG. 4 is a flow diagram of the process to manufacture an embodiment of the invention for the metal fabrication industry using only the resin to adhere the non-woven to the shaft.

FIG. 4 is a flow diagram of the process to manufacture a provided embodiment of a non-woven covered roller for the metal fabrication industry using only the resin to adhere the non-woven to the shaft. Step 401 comprises providing raw materials. Step 402 comprises forming a felt or non-woven tube. Step 403 comprises applying the felt to the customer shaft to form a tubular assembly. Step 404 comprises coating the assembly with convertible resin. Step 405 comprises converting or hardening the resin by drying a convertible resin or simultaneously drying and curing a convertible resin. Step 406 comprises dressing the resin-saturated non-woven covered roller. Finally, step 407 comprises performing a quality check on the finished non-woven covered roller.

Figure 5:
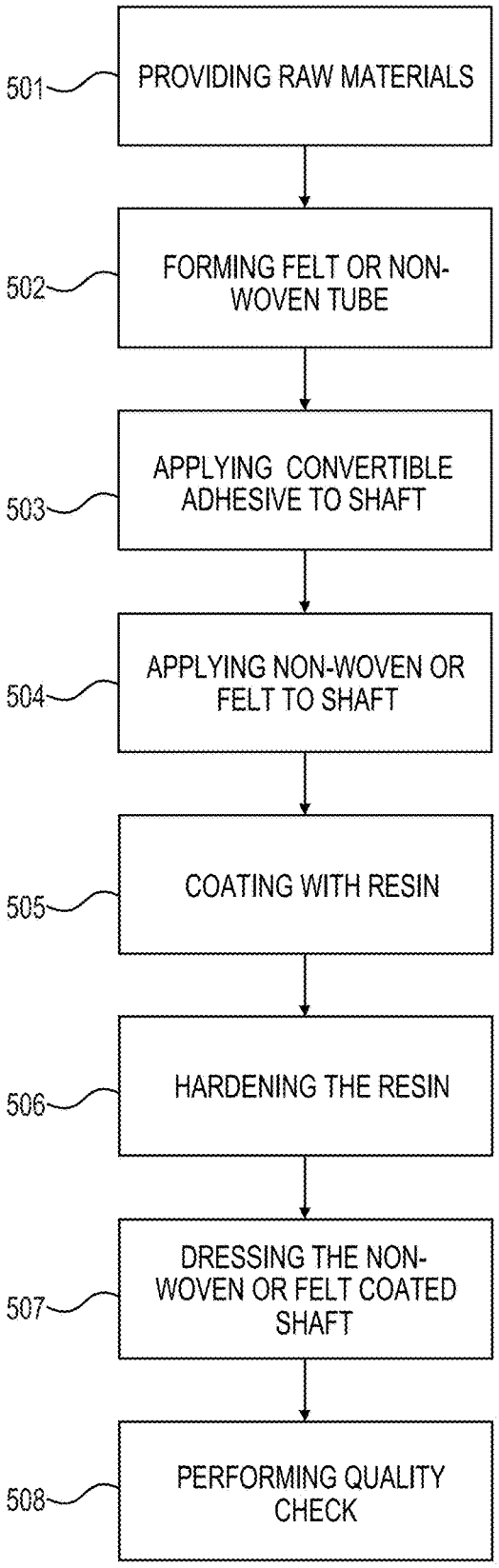
FIG. 5 is a flow diagram of the process to manufacture an embodiment of the invention for the metal fabrication industry using a second curable resin applied to the shaft surface before the non-woven tube is placed on the shaft to augment the adhesion between the non-woven and the shaft.

FIG. 5 is a flow diagram of the process to manufacture another provided embodiment of a non-woven covered roller useful for the metal fabrication industry using a second convertible adhesive applied to the shaft surface before the non-woven tube is placed on the shaft to augment the adhesion between the non-woven and the shaft. Step 501 comprises providing raw materials. Step 502 comprises forming a felt or non-woven tube. Step 503 comprises applying a thin coat of convertible adhesive to the customer shaft. Step 504 comprises applying the felt tube to the convertible adhesive covered customer shaft to form a tubular assembly. Step 505 comprises coating the assembly with convertible resin. Step 506 comprises converting or hardening the resin and adhesive by drying, curing, or simultaneously drying and curing both the convertible adhesive and the convertible resin. Step 507 comprises dressing the non-woven covered roller. Finally, step 508 comprises performing a quality check on the finished non-woven covered roller.

Figure 6:
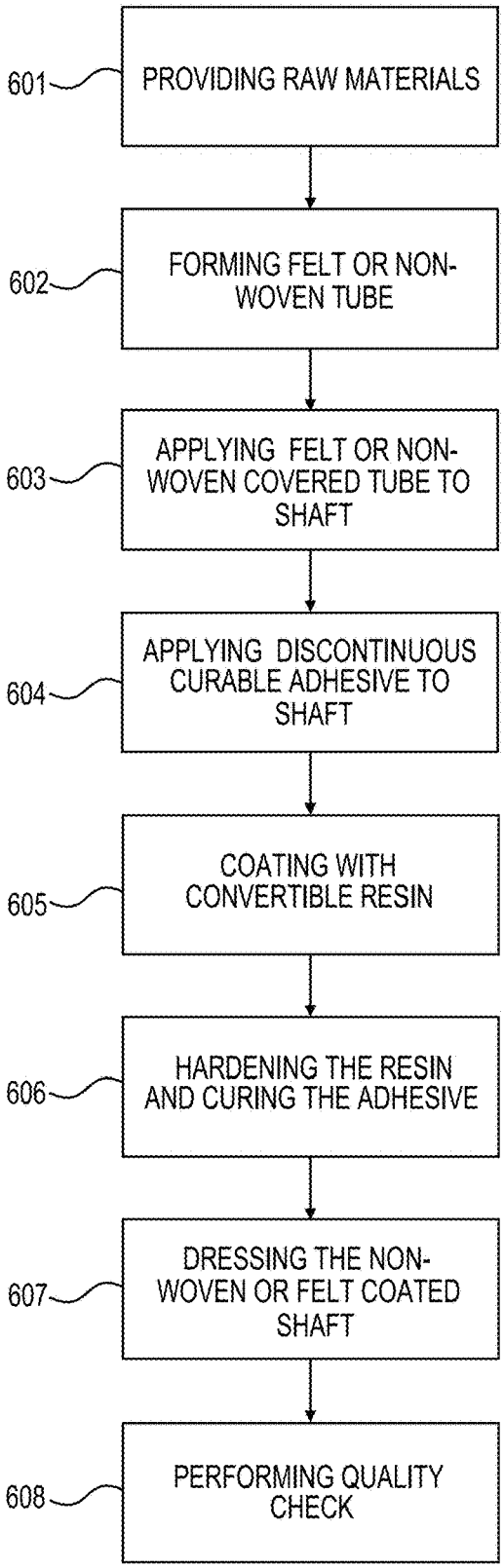
FIG. 6 is a flow diagram of the process to manufacture an embodiment of the invention for the metal fabrication industry using at least a second curable resin applied through the non-woven surface to the shaft surface after the non-woven tube is placed on the shaft to augment the adhesion between the non-woven and the shaft.

FIG. 6 is a flow diagram of the process to manufacture another provided embodiment of a non-woven covered roller for the metal fabrication industry using at least a second convertible adhesive applied through the non-woven surface to the shaft surface after the non-woven tube is placed on the shaft to augment the adhesion between the non-woven and the shaft. Eight steps are illustrated. Step 601 comprises providing raw materials. Step 602 comprises forming a felt or non-woven tube. Step 603 comprises applying the felt or non-woven tube to the adhesive-covered customer shaft to form a tubular assembly. Step 604 comprises applying a thin coat of convertible adhesive in discontinuous regions to the customer shaft. Step 605 comprises coating the assembly with convertible resin. Step 606 comprises converting or hardening the resin and adhesive by drying, curing, or simultaneously drying and curing both the convertible adhesive and the convertible resin. Step 607 comprises dressing the non-woven covered roller. Step 608 comprises performing a quality check on the finished non-woven covered roller.

Figure 7A:
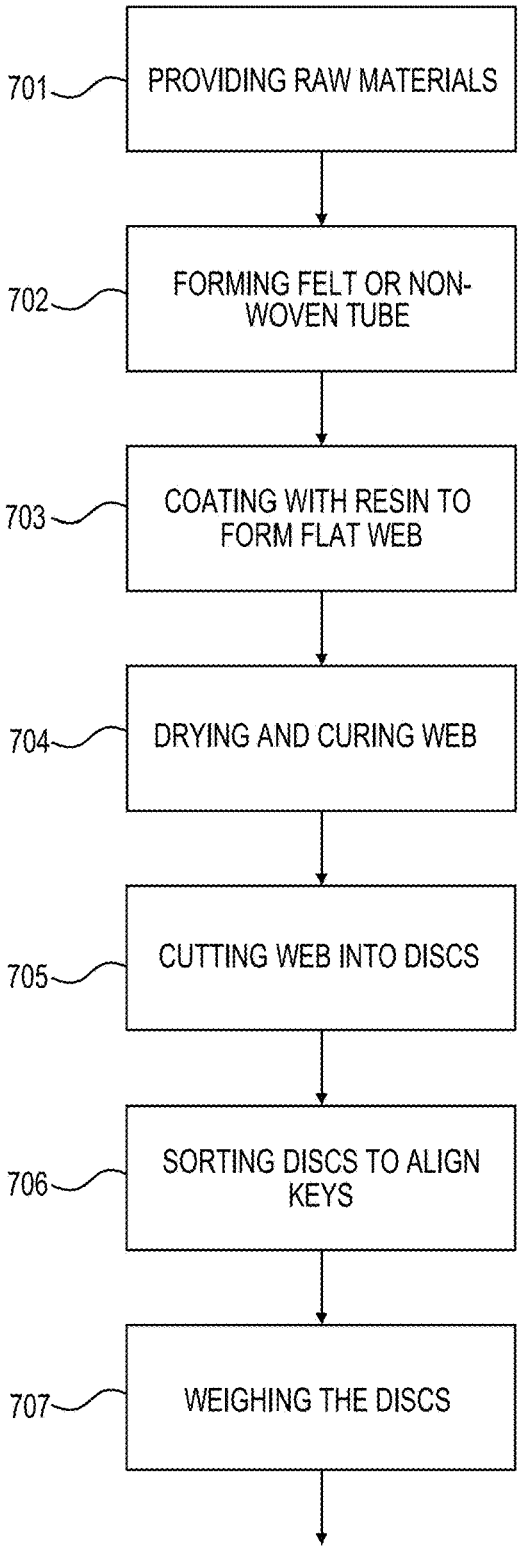
FIG. 7A is the first portion of a multistep flow diagram of the process to manufacturing current non-woven coated rollers for the metal fabrication industry.
Figure 7B:
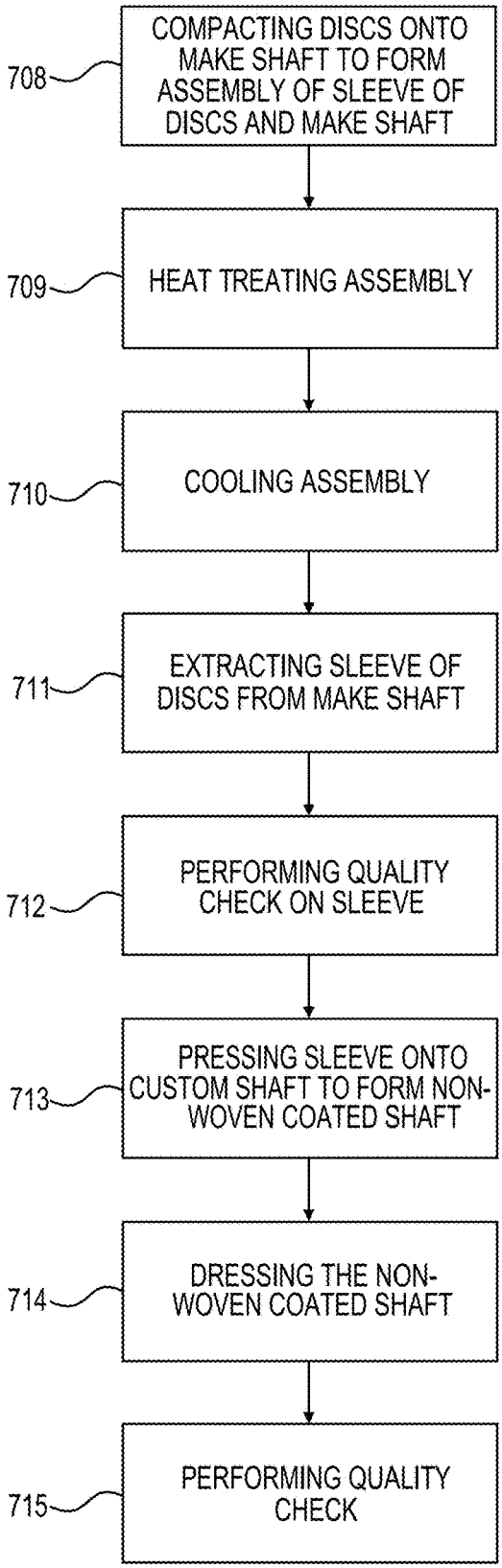
FIG. 7B is the second portion (continuation) of the multistep flow diagram of FIG. 7A.

FIGS. 7A and 7B illustrate a flow diagram of a process to manufacturing current known non-woven covered rollers for the metal fabrication industry. Step 701 comprises providing raw materials. Step 702 comprises forming a felt or non-woven web. Step 703 comprises coating the web with a curable resin to form a flat web. Step 704 comprises drying and curing the web. Step 705 comprises cutting web into discs. Step 706 comprises sorting the discs to align keys. Step 707 comprises weighing the discs. Step 708 comprises compacting the discs onto a make shaft to form an assembly comprising a sleeve of discs and a make shaft. Step 709 comprises heat treating the assembly. Step 710 comprises cooling the assembly. Step 711 comprises extracting the sleeve of discs from the make shaft. Step 712 comprises performing a quality check on the sleeve. Step 713 comprises pressing the sleeve onto a custom shaft with keys to form a non-woven Step 714 comprises dressing the non-woven covered shaft. Step 715 comprises performing a quality check on the finished non-woven covered roller.

As seen, the methods of the invention have much fewer steps that generate much less waste in materials.

EXAMPLES

Various properties are needed for satisfactory use as covered shafts in primary metal fabrication applications. One property is that the life should be at least as long as that of rubber, urethane or vinyl covered shafts. The covered shaft should remain cohesive and not adversely degrade through loss of adhesion of the non-woven to the shaft or catastrophic loss of cohesion of the non-woven tube through wear or tearing under conditions used in the primary metal fabrication process. A second property is hardness of the non-woven covering of the invention in both wet and dry Shore A. Wet hardness better measures hardness during use conditions. Dry hardness is easier for a customer to measure. A third property is the ability of the non-woven covered rollers to remove fluid, also known as wringing.

Examples of resin-saturated seamless non-woven tubes on shafts were made for evaluate if the properties of the non-woven covered shafts of the invention were suitable for applications in the primary metal fabrication process, at least in place of current rubber, urethane, or vinyl covered shafts. Examples were made with (1) one convertible resin emulsion, a curable acrylate latex emulsion resin with a solids of 33 wt. % and a Brookfield 25° C. viscosity of 20 cP, density when dry and cured is 17.54 grams per cubic inch (0.63 ounces per cubic inch or 1.09 grams per cubic centimeter), and (2) one non-woven, Nylon 6,6 High Density 6 denier fiber, density of bare fiber is 18.58 grams per cubic inch (0.67 ounces per cubic inch or 1.15 grams per cubic centimeter). The emulsion was diluted with tap water to form emulsions with different weight ratios of emulsion to tap water to keep the coating volume similar while changing the resin to fiber ratio for each example. Most examples had similar fiber tube lengths, outer and inner diameters, and fiber densities. The resin emulsions were applied to seamless non-woven tubes on shafts as discussed above while the shafts were rotating in a room with a temperature of 255° F.

(124° C.) for 12 hours. The rolls were then dressed. The resulting resin-saturated non-woven covered rollers had various ratios of resin to fiber, wet Shore A hardness and dry Shore A hardness. The construction and hardness of the examples are in the table of FIG. 8.

Figure 9:
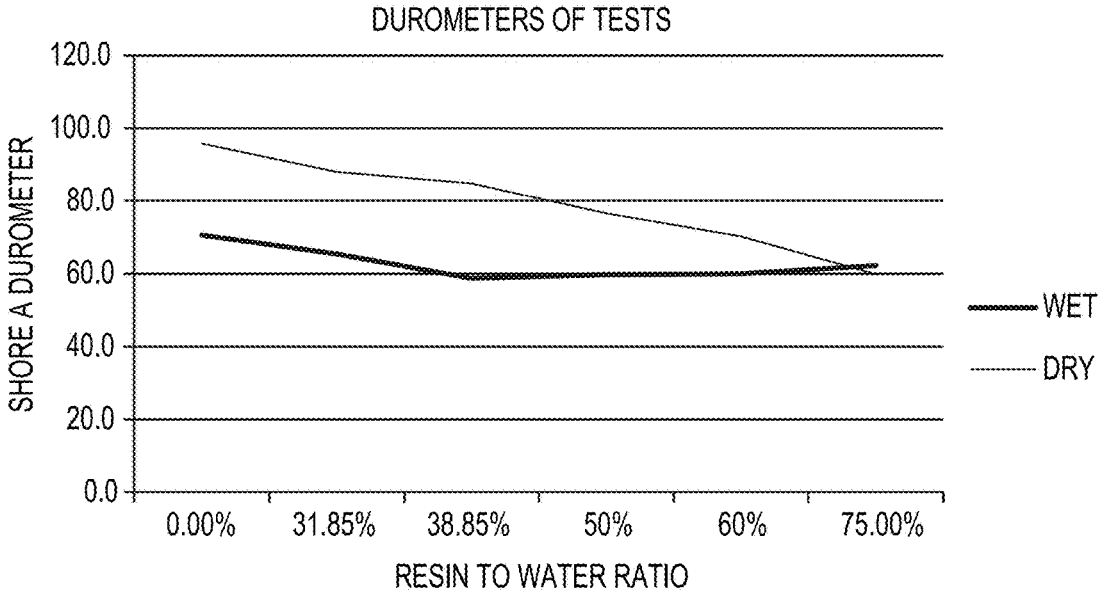
FIG. 9 is Shore A hardness of non-woven coated shaft made with resin having different amounts of diluent water.

Durometer data was gathered for each sample under dry and wet conditions in order to show the correlation of the hardness of the resin-saturated non-woven sleeve with a decrease in resin applied to the non-woven roll. Example 5 and 6 had similar resin to fiber wt. ratios even though the resin concentration was different because the fiber density was also different. FIG. 9 is a graph of the hardness, both wet and dry, of the resin-saturated non-woven of each example as diluent water is added. FIG. 9 shows that some control of the sleeve hardness was possible with varying the amount or resin being applied to the non-woven tube. At lower amounts of applied resin, the hardness values for wet and dry conditions converged.

Next a wringing test was performed. The wringer performance of a primary metal fabrication industrial roll is one of the most important factors to many users. In general, wringer rolls should remove as much solution as possible from the surface of the metal coil being processed. The type and temperature of the solution, the line speed, the pressure on the roll, and its density will all affect the wringer performance in a real application. Wringing efficiencies or all densities generally increase with increased pressure and temperature and decrease with increased roller hardness. While rubber, urethane, and vinyl covered rollers can outperform non-woven covered rollers in wringing efficiency when brand new, their surface become damaged so quickly they cannot sustain good wringing for very long. In nearly all cases there is an acceptable amount of wringing that needs to be achieved and better than that is good but not necessary.

The wringing test is configured to determine the wringing capabilities of different Examples under sustainable and specific conditions.

The wringer test is a 48 hour, 24 hours standard operation and 24 hours after large metal debris is pressed against the Example to determine recovery properties. In this test a machine simulates a field setting for a small roll compressed onto a shaft. The drive roll is an 8 in (20 centimeters (cm)) diameter steel roll that is meant to simulate a steel strip. To further simulate actual conditions, it is partly submerged in water heated to around 180° F. An example roll is placed on top with a pressure of 75 pounds of force per inch (13 newton per hour) at the nip. The test is run at 600 ft/min (183 meters/min (m/min)) surface speed. In the first phase, every two hours a measurement of the amount of water the roll is allowing through the nip is taken (considered "pass through") by weighing pre-weighed paper towels laid against the example roll after the nip. This portion of the test is a 24 hour accelerated condition test.

The second phase is an examination of damage recovery. A forked damaging tool is run through the drive roll and the test roll for a constant one minute to simulate an aggressive damaging in the field. The test is then done in the same way phase one is, but close attention is paid to the speed (if at all) the pass through comes back down after the large spike due to damage. This phase is run for another 24 hours. The parameters of water temperature, line speed, and pressure on the roll are defined. The data collected during this test were the amounts of water carry out from the roll nip measured in grams.

Figure 10:
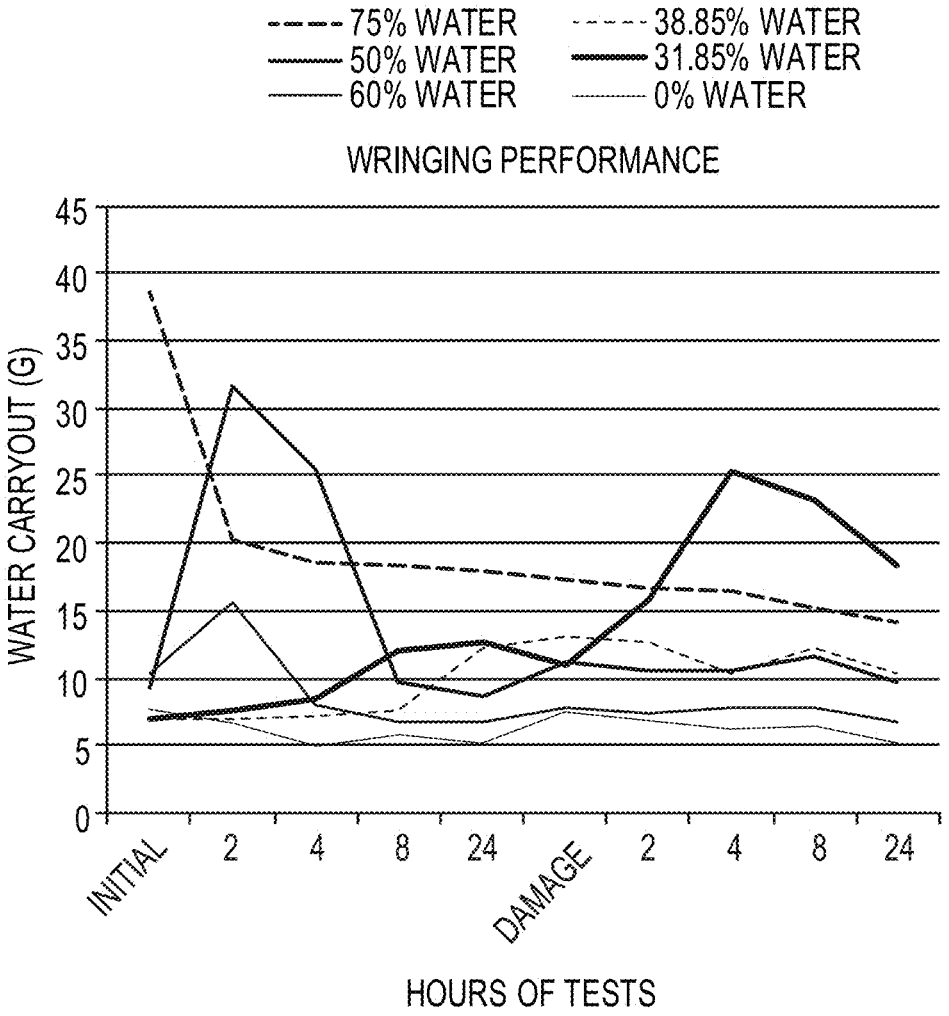
FIG. 10 is a graph showing the wringing characteristics of various embodiments of the invention having different weight ratios of resin to non-woven.

FIG. 10 is a graph showing the wringing test results of various embodiments of the invention having different weight ratios of resin to non-woven as shown in Table 8. Shown is the amount of water carryover in grams vs. the hours of the test. Results of the wringing test are shown in the graph of FIG. 10. Close observation of this graph shows that as the amount of resin was reduced the wringing capability was diminished. Also, surprisingly, it was noted that the examples of non-woven coated rollers of the invention over the entire range of resin to fiber were not a susceptible to the damage portion of the wringing test in a manner similar to that of other commercially available non-woven coated rollers. As the resin decreases, the amount of carryover increases. A number less than 20 grams indicates the example is useful in wet applications such as wringer rolls. All the samples were suitable.

The third test is a PLI test to determine the life of the non-woven roller under fabrication conditions. Specifically the internal durability of the resin-saturated seamless non-woven tube and the lifespan of the roller are suggested.

The pressure capability of primary metal fabrication industrial roll is an important factor in choosing the right product for each application. The longevity of rolls is a byproduct of the amount of pressure and temperature they can withstand before catastrophic failure. This pressure can be measured in pounds per liner inch or PLI. Catastrophic failure can occur under the combination of pressure and increased temperature due to that pressure.

The examples were next run through the PLI test. The PLI test involved running a steel wheel on the surface of the roll while increasing pressure every 20 minutes by increments of 2 PSI to simulate severe roll damage in laboratory circumstances. The depression from the roll and the temperature at the same spot were measured and recorded as the pressure and in relation the damage increases. The PLI test was usually done with the sample roll used in the Wringer Test. The test produced a set of data for a scheduled increase in line pressure every twenty minutes. During the scheduled stop and data logging, the temperature and deformation/depression were measured. The pressure was then increased in set amounts from starting pressure and the test is run again until there is catastrophic failure indication failure of adhesion of non-woven tube to the shaft or until the temperature reaches 300° F. (149° C.).

Figure 11:
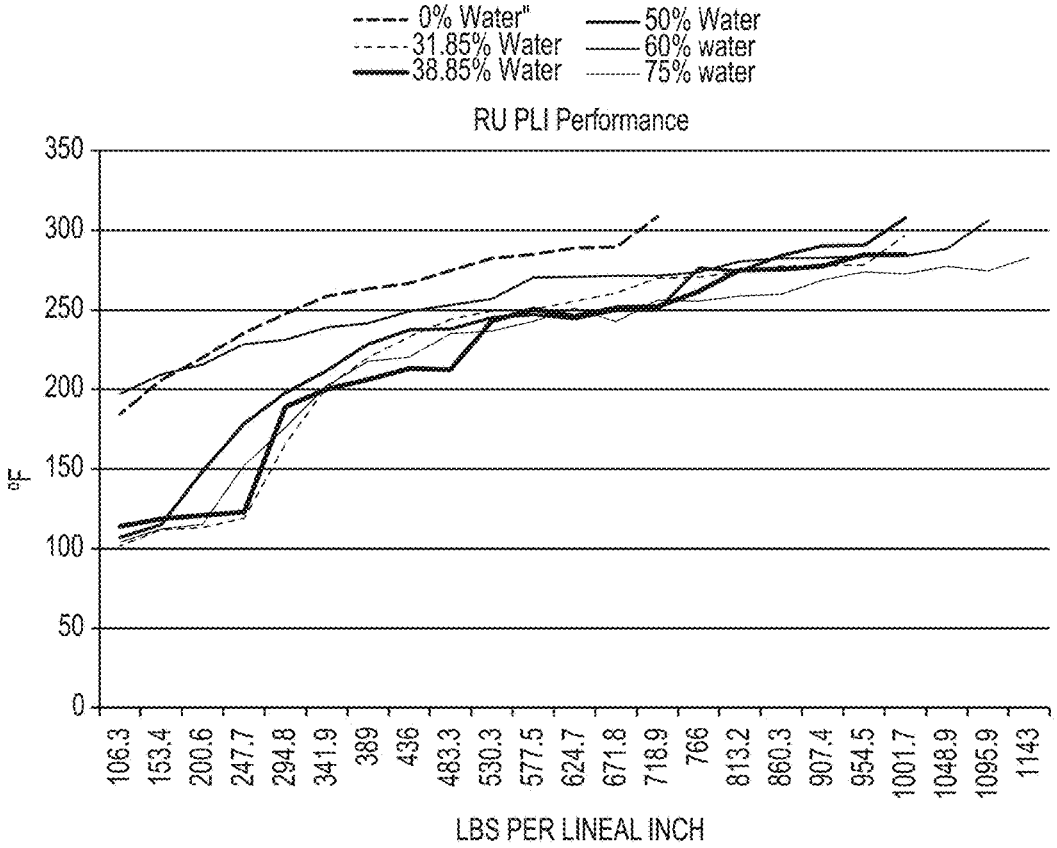
FIG. 11 is a graph showing the life of various embodiments of the invention having different weight ratios of resin to non-woven.

Test results for the sample rolls are shown in the graph of FIG. 11. This graph shows the life of various embodiments of the invention having different weight ratios of resin to non-woven. Measured were the pounds per linear inch tested and how the non-woven covered rollers of the examples is effected by increase pressure. The examples like other commercial non-woven covered rollers will fail with excessive pressure. Surprisingly, none of the examples failed in adhesion over the range of pressures tested—even that with the least amount of resin. The examples have a higher initial indentation than other commercial products, but are capable of withstanding pressures equivalent to the capacity of typical commercial non-woven covered rollers. Example 3 with 38.85% diluent water had an unexpected spike in temperature after 4 hours into the second phase because the example had been allowed to dry over the weekend. Examples with less and more diluent water behaved with good lifespan results. This graph also shows that the pressure capability increased with less resin. Also, the temperature that the examples failed at was 50° F. (27.7° C.) higher than all other commercial non-woven shafts tested. A distinct change in the roll appearance was observed at the lowest resin example corresponding to the resin to fiber ratio of 8:92 indicating that the fibers were not saturated at this ratio.

In conclusion, the Examples were adequate as a wringer rolls, and showed promising attributes for use as a table roll or tension roll. By varying the resin content there is the potential for different variations of a product that could be tailor to the customer's needs/requirements, and reducing cost to manufacture.

Other modifications and changes regarding my invention will be apparent to those skilled in the art. The invention is not considered limited to the embodiments chosen for purposes of disclosure and covers all changes and modifications that do not constitute departures from the true spirit and scope of this invention.

What is claimed is:

1. A non-woven covered roller comprising:

a shaft with a uniform smooth outer surface without keys; and a converted-resin-saturated non-woven seamless tube adhered to the shaft, wherein the converted-resin-saturated non-woven seamless tube has an outer surface and an inner surface and comprises:

a non-woven seamless tube comprising a needle-tacked web of fibers formed into a seamless tube; and a continuous converted resin layer that saturates the non-woven seamless tube and coats the outer surface of the shaft to bond it to the converted-resin-saturated non-woven seamless tube under a roll face pressure of 444.7 kPa (50 PSI) and temperature of 149° C. (300° F.) for 100 hours when exposed to metal debris from a metal web during primary metal fabrication operations of the non-woven covered roller and wherein the non-woven covered roller has a hardness of at least 35 wet Shore A and the converted-resin-saturated non-woven seamless tube has a void volume of at least 4 percent.

2. A non-woven covered roller according to claim 1, wherein the outer surface of the converted-resin-saturated non-woven seamless tube is capable of trapping metal debris from a metal web during primary metal fabrication operations and capable of temporarily compressing to allow defects associated with the metal web to pass by without tearing or gouging the outer surface of the converted-resin-saturated non-woven seamless tube to prevent the converted-resin-saturated non-woven seamless tube from removing water from the entire metal web.

3. A non-woven covered roller according to claim 1, wherein the void volume of the converted-resin-saturated non-woven seamless tube is less than 63 percent.

4. A non-woven covered roller according to claim 1, wherein the converted-resin-saturated non-woven seamless tube has a weight ratio of converted resin to non-woven fibers of at least 10:90 and not more than 85:15.

5. A non-woven covered roller according to claim 1 wherein the converted-resin-saturated non-woven seamless tube has a density of at least 5 grams per cubic inch (0.18 ounces per cubic inch or 0.31 grams per cubic centimeter) and up to 18 grams per cubic inch (0.63 ounces per cubic inch or 1.10 grams per cubic centimeter).

6. A non-woven covered roller according to claim 1, wherein the non-woven covered roller further comprises a discontinuous layer of adhesive between the converted resin and the outer surface of the shaft.

7. A non-woven covered roller according to claim 1, wherein the non-woven seamless tube is configured to operate at temperatures of up to 149° C. (300° F.) and pressures of up to 444.7 kPa (50 PSI) of roll face.

8. A method of making a non-woven covered roller comprising:

providing an unconverted resin that when converted forms a converted resin stable at the conditions of metal working, a non-woven seamless tube comprising physically adhered non-woven fibers, and a shaft with a uniform smooth outer surface without keys;

applying the non-woven seamless tube to the shaft to form a non-woven seamless tube covered shaft;

coating the non-woven seamless tube covered shaft with the unconverted resin so that the non-woven seamless tube covered shaft becomes saturated with a continuous layer of unconverted resin that contacts both the fibers and the outer surface of the shaft to form an unconverted-resin-saturated non-woven seamless tube covered shaft; and rotating the unconverted-resin saturated non-woven seamless tube covered shaft under resin converting conditions to form a converted-resin-saturated non-woven seamless tube with an outer surface and an inner surface adhered to the shaft, wherein the converted-resin-saturated non-woven seamless tube comprises: a non-woven seamless tube comprising needle-tacked web of fibers formed into a seamless tube; and a continuous converted resin layer that saturates both the non-woven seamless tube and coats the outer surface of the shaft to bond it to the converted-resin-saturated non-woven seamless tube under a roll face pressure of up to 444.7 kPa (50 PSI) and temperature of up to −149° C. (300° F.) for at least 100 hours when exposed to metal debris from a metal web during primary metal fabrication operations of the non-woven covered roller.

9. A method of making a non-woven covered roller according to claim 8, wherein the non-woven covered roller has a hardness of at least 35 wet Shore A and the converted-resin-saturated non-woven seamless tube has a void volume of at least 4 percent.

10. A method of making a non-woven covered roller according to claim 8, wherein the converted-resin-saturated non-woven seamless tube has a weight ratio of converted resin to non-woven fibers of at least 10:90 and not more than 85:15.

11. A method of making a non-woven-covered-roller according to claim 8, further comprising solidifying the unconverted resin while continuously rotating the unconverted-resin-coated-non-woven seamless tube covered shaft.

12. A method of making a non-woven covered roller according to claim 8, further comprising dressing the outer surface of the converted-resin-saturated seamless non-woven tube.

13. A method of making a non-woven covered roller according to claim 8, further comprising:

providing a convertible adhesive; and coating the surface of the shaft with a thin layer of the convertible adhesive before applying the seamless non-woven tube to the shaft; and also converting the thin layer of adhesive while rotating the unconverted-resin-coated non-woven seamless tube covered shaft wherein the unconverted adhesive and unconverted resin at least partially intermix to increase the adhesion of the converted-resin coated-non-woven tube to the shaft upon solidification.

14. A method of making a non-woven covered roller according to claim 13, wherein the thin layer of adhesive is continuous and has a thickness of less than about 5.1 mm.

15. A method of making a non-woven covered roller according to claim 8, further comprising:

providing a convertible adhesive;

injecting the convertible adhesive between the non-woven seamless tube and the outer surface of the shaft so as to form at least one discontinuous region of adhesive on the shaft; and converting the convertible adhesive while rotating the unconverted-resin coated non-woven seamless tube covered shaft.

16. A method of making a non-woven covered roller according to claim 15, wherein the discontinuous layer of adhesive has a thickness of less than 5.1 mm (200 mils).

17. A method of making a non-woven covered roller according to claim 8, wherein the non-woven covered roller can be used as a replacement in primary metal fabrication where rubber, vinyl, or urethane covered rollers are currently used.

18. A method of making a non-woven covered roller according to claim 8, wherein the non-woven covered roller is used as a mill roll selected from brindle rolls, deflector rolls, table rolls, ironing rolls, and steering rolls.

* * * * *